US009915216B2

(12) United States Patent
Horn

(10) Patent No.: US 9,915,216 B2
(45) Date of Patent: Mar. 13, 2018

(54) METHOD FOR ASCERTAINING THE ABSOLUTE INJECTION QUANTITY IN AN INTERNAL COMBUSTION ENGINE AND THE SYSTEM FOR THIS PURPOSE

(71) Applicant: Robert Bosch GmbH, Stuttgart (DE)

(72) Inventor: Christian Horn, Esslingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 117 days.

(21) Appl. No.: 14/901,220

(22) PCT Filed: May 30, 2014

(86) PCT No.: PCT/EP2014/061233
§ 371 (c)(1),
(2) Date: Dec. 28, 2015

(87) PCT Pub. No.: WO2014/206684
PCT Pub. Date: Dec. 31, 2014

(65) Prior Publication Data

US 2016/0369732 A1 Dec. 22, 2016

(30) Foreign Application Priority Data

Jun. 26, 2013 (DE) ..... 10 2013 212 334

(51) Int. Cl.
*F02M 51/00* (2006.01)
*F02D 41/24* (2006.01)

(52) U.S. Cl.
CPC ..... *F02D 41/2467* (2013.01); *F02D 41/2438* (2013.01); *F02D 2200/0614* (2013.01); *F02D 2200/1012* (2013.01)

(58) Field of Classification Search
CPC ..... F02D 2200/0614; F02D 41/402; F02D 2041/224; F02D 19/061; F02D 19/0623; F02D 41/2438; Y02T 10/44
(Continued)

(56) References Cited

U.S. PATENT DOCUMENTS

2002/0104520 A1* 8/2002 Nakasaka ..... F01L 1/053 123/673
2014/0311453 A1* 10/2014 Christ ..... F02D 41/3809 123/456
(Continued)

FOREIGN PATENT DOCUMENTS

CN 102477909 A 5/2012
DE 10 2007 010496 10/2008
(Continued)

*Primary Examiner* — Marguerite McMahon
*Assistant Examiner* — Tea Holbrook
(74) *Attorney, Agent, or Firm* — Norton Rose Fulbright US LLP; Gerard Messina

(57) ABSTRACT

A method for ascertaining the absolute fuel injection quantity of the injectors of an internal combustion engine including a cylinder number, the average absolute total injection quantity of the injectors being ascertained based on a run-up test in which all cylinders of the engine are active, recorded measurement data, and a predetermined engine-specific factor which is proportional to the moment of inertia of the engine when all cylinders are active, and the measurement data being essentially suited for describing the chronological progression of the engine speed during the run-up test, in particular a reached maximum engine speed, a first rate of change of the engine speed during the run-up with active injection, a second rate of change of the engine speed with inactive injection, and an idling speed of the engine.

8 Claims, 2 Drawing Sheets

(58) Field of Classification Search
USPC ..... 701/101–105
See application file for complete search history.

(56) References Cited

U.S. PATENT DOCUMENTS

| | | | | |
|---|---|---|---|---|
| 2015/0019110 | A1* | 1/2015 | Suzuki | F02D 41/2467<br>701/103 |
| 2015/0046066 | A1* | 2/2015 | Miyaura | F02D 41/0085<br>701/104 |
| 2015/0369361 | A1* | 12/2015 | Matsubara | F16H 61/143<br>477/169 |
| 2016/0053702 | A1* | 2/2016 | Nada | F02D 41/403<br>123/294 |

FOREIGN PATENT DOCUMENTS

| | | |
|---|---|---|
| DE | 10 2010 038630 | 2/2012 |
| EP | 0 463 537 | 1/1992 |
| WO | WO 2004/053316 | 6/2004 |

* cited by examiner

METHOD FOR ASCERTAINING THE ABSOLUTE INJECTION QUANTITY IN AN INTERNAL COMBUSTION ENGINE AND THE SYSTEM FOR THIS PURPOSE

FIELD OF THE INVENTION

The present invention relates to a method for ascertaining the absolute fuel injection quantity of the injectors of an internal combustion engine including a cylinder number.

BACKGROUND INFORMATION

The run-up test is a known diagnostic test for ascertaining the injection quantity error for injectors in an internal combustion engine.

For example, a method for comparative testing of injection internal combustion engines is discussed in DE 10 2007 010 496 A1 in which the engine is controlled by an electrical engine controller which either has a self-diagnostic arrangement or is equipped with a connection interface for an external diagnostic device. Using the self-diagnostic arrangement or the diagnostic device, information may be obtained from the measured and displayable deviations of each of the defined measured variables by switching off one cylinder each, and may be indicative of a possible setpoint deviation of the switched-off cylinder. For example, the relative injection quantities of the individual cylinders may be inferred from comparing the maximum engine speed achieved during the run-up test. Starting from an idling speed, a certain number of injections are thereby activated using a predetermined fixed injection quantity so that the engine accelerates up. One individual cylinder is deactivated per test run. The relative injection quantity per test run may be inferred from the reached maximum engine speed.

However, since the torque requirement due to friction and other effects (e.g., power train elements connected to the engine) is not known, the absolute injection quantity may not be ascertained.

Therefore, for example, in the case of a four-cylinder engine, if a greater quantity was ascertained for two cylinders relative to the other two cylinders, it remains unclear whether the two cylinders with the smaller injection quantity have a quantity shortfall and the cylinders with the larger injection quantity inject the correct quantity, or whether the two cylinders with the smaller injection quantity inject the correct quantity and the cylinders with the larger injection quantity have an excess quantity. This means that it is not clear which injectors have to be exchanged.

SUMMARY OF THE INVENTION

It is thus an object of the present invention to provide a method for ascertaining the absolute average injection quantity for all injectors, in particular the absolute injection quantity of one injector, in order to be able to determine an absolute injection quantity error.

This object may be achieved by the features of the descriptions herein. Further specific embodiments are indicated in the subclaims back-referenced to these.

Additional features and details of the present invention arise from the subclaims, the description, and the drawings. Features and details, which are described in conjunction with the method according to the present invention, thereby also apply naturally in conjunction with the system according to the present invention, and respectively vice versa, so that reference is always reciprocally made or may be made with respect to the disclosure of individual aspects according to the present invention.

It has been recognized that, during the run-up test, the torque requirement of the engine due to friction or power train elements connected to it may be inferred essentially from the speed with which the engine speed drops, as long as no injection is active, and thus, the absolute injection quantity may be inferred directly from the reached maximum engine speed. For this purpose, only knowledge of a predeterminable engine-specific factor f is necessary, which is proportional to the moment of inertia of the engine, among other things.

An important aspect of the present invention essentially includes storing the mentioned predeterminable engine-specific factor f for the respective engine in an engine controller and/or a repair shop diagnostic test device. With the aid of the factor stored for the respective engine, the absolute total injection quantity and the individual injection quantities of the individual injectors at a defined operating point may thus be determined and evaluated with the aid of a run-up test.

It is particularly advantageous that the implementation of the present invention requires no structural change in existing engine controllers and repair shop diagnostic devices, but instead requires only an improved evaluation according to the present invention—if necessary depending on functions available in the engine controller or the repair shop diagnostic device—e.g., of the measurement data recorded during the known run-up test.

If the absolute injection quantity of the individual injectors is known, then it may be determined which injectors are injecting erroneously. It is thus clearly obvious which injector must be exchanged. Repair shop costs may thus be reduced.

A method according to the present invention for ascertaining the absolute fuel injection quantity of the injectors of an engine of the type of an internal combustion engine having a cylinder number NZ may include the step: ascertaining a first absolute total injection quantity $M_{inj}(nz=NZ)$ of all injectors, based on recorded measurement data during a run-up test in which all cylinders of the engine are active, and a predetermined engine-specific factor f(nz=NZ) which was determined for the case in which all cylinders are active. The recorded measurement data are essentially those which are suited for describing the chronological progression of engine speed n(t) during the run-up tests, in particular during the run-up with active injection, and during the fall back to idling speed at inactive injection.

The measurement data to be recorded during the run-up test may be, for example, a reached maximum engine speed $n_{max}$, a first rate of change $$a_1 = 2\pi \frac{dn}{dt}$$

of engine speed n(t) during the run-up with active injection (run-up phase), a second rate of change $$a_2 = 2\pi \frac{dn}{dt}$$

of the engine speed with inactive injection (free-fall phase), and an idling speed $n_{idle}$ of the engine. It is obvious to those skilled in the art that, for individual or all measurement data $a_1$, $a_2$, $n_{idle}$, $n_{max}$, other equivalent measured values or corresponding combinations of measured values may be used in order to describe the chronological progression of the engine speed with sufficient precision. For example, the rates of change $a_1$ and $a_2$ may be calculated on the basis of point in time $t_1$ at the beginning of the run-up phase, at point in time $t_2$ at the end of the run-up phase or the beginning of the free-fall phase, and at point in time $t_3$ at the end of the free-fall phase, together with the measured values for $n_{idle}$ and $n_{max}$. In other words, it is sufficient to determine those measured values on the basis of the chronological progression of engine speed n(t), from which variables $a_1$, a2, $n_{idle}$, and $n_{max}$ may be derived in the evaluation.

For example, during the run-up test, the engine to be tested may be accelerated with the aid of a defined number N of injections per active cylinder, whereby maximum engine speed $n_{max}$ is reached (run-up phase). Thereafter, no more injections are carried out until the speed of the engine falls freely back to the idling speed (free-fall phase); this is recognizable, for example, when the idling speed controller engages again.

Based on the first absolute total injection quantity $M_{inj}$ (nz=NZ), the absolute mean injection quantity per injector $\overline{m}_{inj}$ may be ascertained in that the total injection quantity is divided by the number nz of cylinders of the engine with active injection, and by the total number N of injections carried out per cylinder during the run-up.

In one refinement of the method according to the present invention, at least one second absolute total injection quantity $M_{inj}$(nz=NZ−1) is ascertained based on measurement data of another run-up test, in which at least one of the cylinders is inactive, and a predeterminable engine-specific factor f(nz−1) is used which was determined for the engine with one inactive cylinder. Inactive cylinder means here that the injector of this cylinder does not inject fuel into this cylinder in the run-up phase.

Based on the first and the at least one second absolute total injection quantity, the absolute injection quantity, and thus the individual injection quantity drift of a specific individual injector $m_{inj}$, may be ascertained for the cylinder which was inactive during the ascertainment of the at least one second absolute total injection quantity. For this purpose, only the ascertained second absolute total injection quantity $M_{inj}$ (nz=NZ−1) has to be subtracted from the ascertained first absolute injection quantity $M_{inj}$(nz=NZ) and the result has to be divided by the number N of injections per cylinder.

The respective absolute total injection quantity $M_{inj}$(nz) may be ascertained based on an energy balance $E_{gez}$.

The respective absolute total injection quantity $M_{inj}$(nz) may be ascertained based on the kinetic energy $E_{idle}$ of the engine at idling speed $n_{idle}$.

The respective absolute total injection quantity $m_{inj}$(nz) may be ascertained based on the output $W_{ext}$ achieved by the engine during the run-up.

A torque requirement $M_{friction}$ to be generated by the engine may be ascertained on the basis of friction and external output based on the second rate of change $a_2$.

An output achieved by the engine up to reaching maximum engine speed $n_{max}$ may be taken into consideration, and thus the absolute total injection quantity is a quadratic function of the reached maximum engine speed $n_{max}$.

The ascertainment of the respective absolute total injection quantity of all cylinders $M_{inj}$(nz) may, in particular, be ascertained based on the following correlation $$M_{inj}(nz) = f(nz)\cdot\left(n_{max}^2 + (n_{max}^2 - n_{idle}^2)\cdot\frac{a_2}{a_1} - n_{idle}^2\right)$$

where f(nz) is the constant predetermined factor for the engine at nz active cylinders.

Factor f is an individual factor for each engine, which is predeterminable for each engine. Factor f may be stored in an engine controller and/or a repair shop diagnostic device for use in a method according to the present invention. This means that factor f may be determined in advance by the manufacturer of the engine for each engine version based on the total injected fuel quantity $M_{inj}$=N·nz·$m_{inj}$ using the following formula:

$$f(nz) = \frac{N\cdot nz\cdot m_{inj}}{n_{max}^2 + (n_{max}^2 - n_{idle}^2)\cdot\frac{a_2}{a_1} - n_{idle}^2}$$

where nz is the number of active cylinders and N is the total number of injections carried out per active cylinder during the run-up phase of the engine from the idling speed $n_{idle}$ up to the reached maximum engine speed $n_{max}$. The determination of f(nz) is carried out ideally on a vehicle whose injectors have no quantity shortfall or excess quantity, i.e., each injector actually injects the same quantity, namely the quantity $m_{inj}$, required by the engine controller.

For the method according to the present invention, it is sufficient for ascertaining the individual injection quantity of an injector, if factor f(nz) is determined in advance for nz=NZ and for nz=NZ−1.

The method according to the present invention may be implemented with the aid of a system which includes: an appropriately programmed repair shop diagnostic device which is connectable to a connection interface of an appropriately programmed engine controller of an engine. The implementation of the method may he controllably configured by the repair shop diagnostic device and/or the engine controller. At least one predetermined engine-specific factor f(nz), which was determined when nz cylinders are active, may be stored in the repair shop diagnostic device and/or in the engine controller.

The necessary calculations of the injection quantities may he integrated, in the form of an appropriately programmed algorithm, as an integral part of a diagnostic module, into the software of the engine controller and/or the repair shop diagnostic device.

This means that the diagnostic module may be integrated as a software module into the software of an engine controller (controller-based repair shop diagnostic module). After starting by an external repair shop diagnostic device connected to the engine controller via a diagnostic interface, the diagnostic module runs completely autonomously in the engine controller. Upon completion, the diagnostic module reports the test results back to the repair shop diagnostic test device. A controller-based repair shop diagnostic module of this type differs from simple actuator tests in that the vehicle to be diagnosed in the repair shop is shifted into predetermined, load-free operating points by the engine controller, actuator stimuli are impressed, and the result may be autonomously evaluated with an evaluation logic using sensor values.

Alternatively, the diagnostic module may also be integrated as a software module into the software of a repair shop diagnostic test device (diagnostic test-based repair shop diagnostic module). The functional sequence, the evaluation, and the assessment of the method according to the present invention are then carried out in the repair shop diagnostic test device, the measurement data used for the evaluation being ascertained from sensors present in the vehicle or by additional test sensors with the aid of the engine controller.

The present invention may be implemented as a computer program product having computer program code configured in such a way that if the computer program code is executed on a corresponding programmable device, in particular an engine controller and/or a repair shop diagnostic test device, this device executes carried out a method according to the present invention.

Additional advantages, features, and details of the present invention arise from the subsequent description, in which exemplary embodiments of the present invention are described in detail with reference to the drawings. The features thereby mentioned in the claims and in the description may each be essential to the present invention by themselves or in any arbitrary combination.

DETAILED DESCRIPTION

In the subsequent description, specific details are described. It should be understood, however, that embodiments of the present invention may also be used without these specific details. Known circuits, structures, and methods are not shown in detail in order to not complicate an understanding of the present description.

Figure 1:
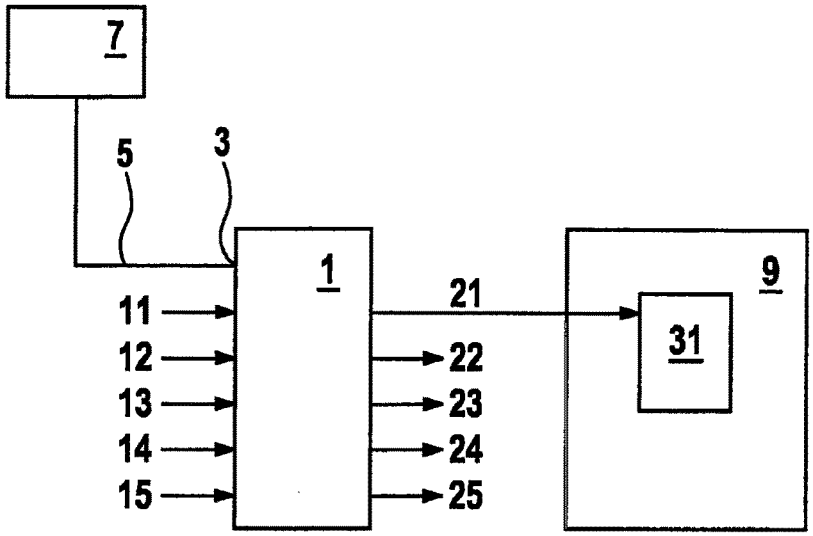
FIG. 1. schematically shows the configuration of a. test system including an engine controller and a repair shop diagnostic test device.

FIG. 1 schematically shows the configuration of a test system including an engine controller and a repair shop diagnostic test device.

An engine controller 1 as an engine control unit is coupled via a diagnostic interface 3 and a diagnostic cable 5 to external diagnostic device 7 as a repair shop diagnostic test device. Engine controller 1 is configured for controlling engine 9 during normal and test operation.

In the exemplary embodiment described here, diagnostic device 7 is configured to transmit the control data necessary for a specific diagnosis to engine controller 1, to control the test procedures, and to retrieve the test results from engine controller 1.

Engine controller 1 detects the data necessary to control engine 9 with the aid of schematically represented sensor inputs 11 through 15. Engine controller 1 is additionally configured to determine control variables necessary for controlling the engine from the detected data according to software modules stored in engine controller 1. This may be carried out by calculation based on stored algorithms, reading out from stored tables or engine characteristic maps, or the like.

Basically, controlled engine 9 may be a spark-ignition internal combustion engine (gasoline engine) or a self-ignition internal combustion engine (diesel engine), fuel being directly injected into the cylinders of engine 9 in each case with the aid of an injector assigned to the respective cylinder.

The control of engine 9 is carried out by engine controller 1 via outputs 21 through 25. To demonstrate the present invention, only the control of one single fuel injector 31 for one of the cylinders of engine 9 is schematically shown here by way of example. The control of fuel injector 31 is carried out via controller output 21. For example, engine controller 1 may actuate a solenoid valve in fuel injector 31 via output 21. A nozzle needle, which opens or closes an associated, injector nozzle, may be actuated hydraulically by the solenoid valve. The opening point in time and the opening duration of the injector nozzles are essential control parameters of the engine. For the present invention, the specific configuration of a fuel injector and the underlying injection principle are not important. It may, for example, be a pump-nozzle injection system or a common-rail injection system.

Engine controller 1 essentially determines the fuel quantity injected into the associated cylinder with the aid of the opening duration of the injector nozzle and the injection pressure. This, in turn, influences power and torque output of the engine.

Figure 2:
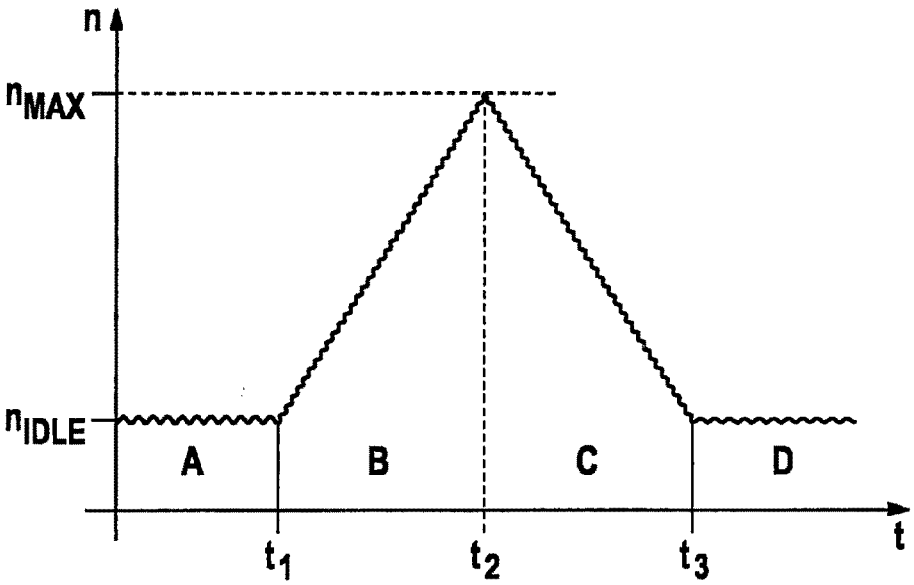
FIG. 2 schematically shows the chronological progression of the engine speed of an engine during a run-up test according to the present invention.

FIG. 2 shows how, in the simplest case, the engine speed progresses during a run-up test according to the present invention.

At the beginning, in the phase marked "A," the started engine is at idling speed, i.e., the idling speed controller is active and keeps the speed at idling speed $n_{idle}$. The run-up test begins at point in time $t_1$. In the phase marked "B," the injection is active beginning from point in time $t_1$, so that the speed of the engine increases approximately linearly at a constant first slope $$a_1 = 2\pi \frac{dn}{dt}$$

up to maximum engine speed $n_{max}$ at point in time $t_2$. In the phase marked "C," beginning at point in time $t_2$, the injection is inactive so that the engine speed drops again approximately linearly at second slope $a_2$. As soon as the idling speed has dropped again to idling speed $n_{idle}$ at point in time $t_3$, the idling speed controller engages again and keeps the speed stable (phase "D").

The torque requirement, which is essentially caused by engine-internal friction and by power train elements connected to the engine, may be determined from:

$$M_{friction} = J \cdot Q_Z \quad (1),$$

where J corresponds to the unknown moment of inertia of the engine.

The total output $W_{total}$ achieved by the engine during phase "B" with active injection, i.e., during run-up, corresponds to the sum of the kinetic energy of the rotating engine $E_{rot}$ at the reached maximum engine speed $n_{max}$ and the achieved external output $W_{ext}$, i.e., overcoming the friction plus driving the power train elements, minus kinetic energy $E_{idle}$ of the engine at idling speed $n_{idle}$.

$$W_{total} = E_{rot} + W_{ext} - E_{idle} = 2\pi^2\left(n_{max}^2 \cdot J + \frac{n_{max}^2 - n_{idle}^2}{a_1} \cdot M_{friction} - n_{idle}^2 \cdot J\right) \quad (2)$$

The output achieved by the engine $W_{total}$ is in turn proportional to the total injection quantity of all cylinders $M_{inj}(nz)$, or to the average injection quantity of the cylinders times number nz of active cylinders times number N of injections per cylinder:

$$W_{total}\mu M_{inj}=N\cdot nz\cdot\overline{m}_{inj} \quad (3)$$

The absolute total injection quantity may be ascertained therefrom by:

$$M_{inj}(nz)=f(nz)\cdot\left(n_{max}^2+(n_{max}^2-n_{idle}^2)\cdot\frac{a_2}{a_1}-n_{idle}^2\right) \quad (4)$$

The engine-specific factor f(nz) thus includes the moment of inertia of the engine as well as the efficiency of the engine, i.e., the kinetic energy generated per gram of fuel.

The inventor has recognized that factor f(nz) is a constant which, in particular, is not a function of the momentary required torque of the engine during the test. Factor f(nz) may therefore be determined once and stored in the controller of the engine or in the software of a repair shop diagnostic device.

The correlation conceived in the above formula (4) may be used in order to ascertain the absolute injection quantity in each case with the aid of measurement data measured during a run-up test. The correlation may basically be integrated as an integral part of a controller-based repair shop diagnostic module into the software of the engine controller. This means that the diagnostic module is integrated as a software module into the engine controller and runs completely autonomously in the engine controller after the start by the externally connected repair shop diagnostic test device and reports the result to the diagnostic tester upon completion.

Alternatively, an integration into a diagnostic test-based repair shop diagnostic module is also possible, i.e., the sequence, the evaluation, and the assessment of the test according to the present invention are thereby carried out in the repair shop diagnostic test device; the measurement data gathered with the aid of the engine controller for the evaluation may be ascertained by sensors present in the vehicle or by additional test sensors.

Thus, to implement the present invention, essentially only an adaptation of software present in the engine controller and/or diagnostic devices is necessary in order to implement the method according to the present invention.

Figure 3:
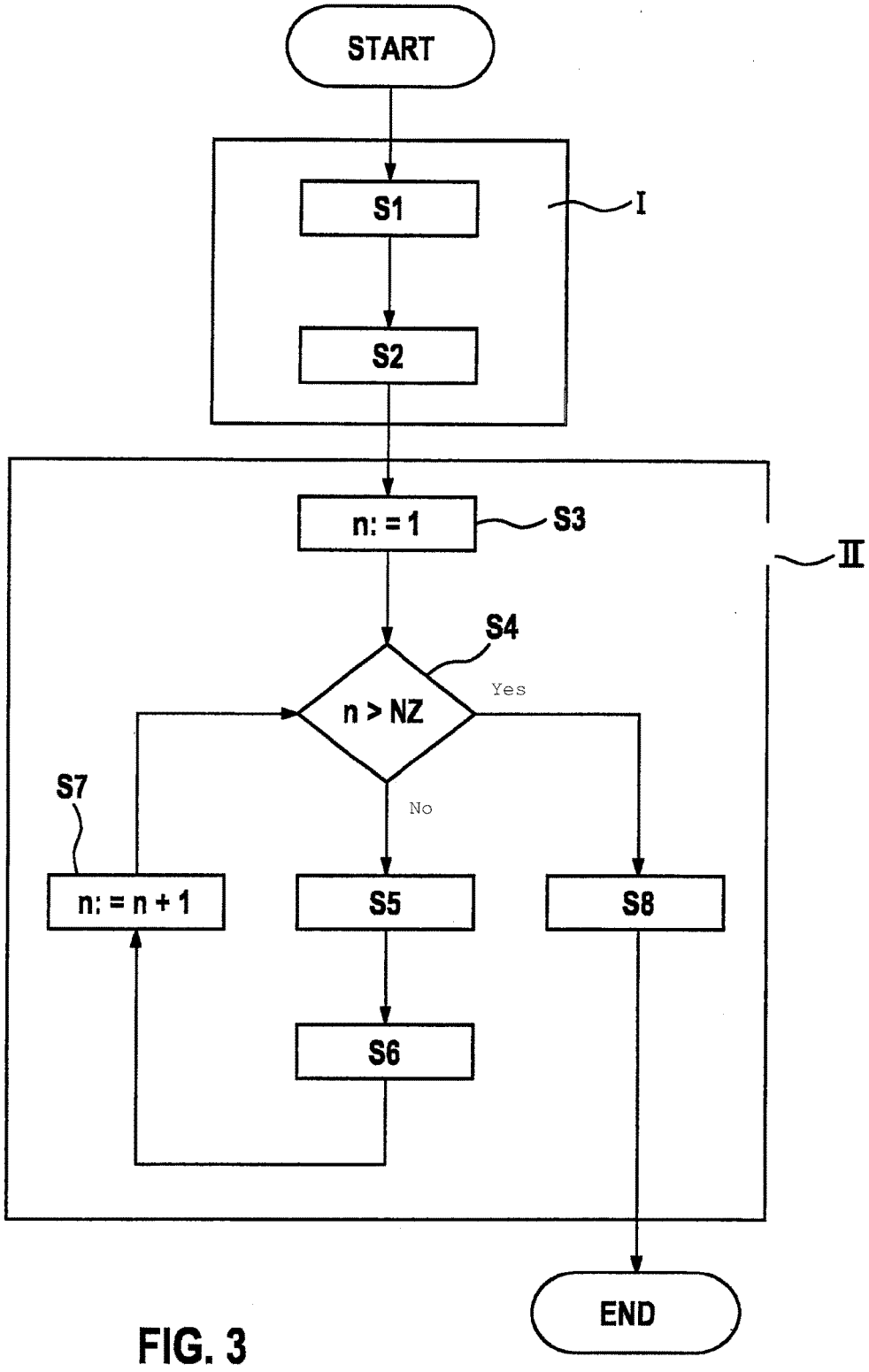
FIG. 3 schematically shows a flow chart of a possible implementation of the method according to the present invention to ascertain the absolute injection quantity.

FIG. 3 illustrates, as a flow chart, a possible implementation of the method according to the present invention for determining the absolute injection quantity of an injector.

In a first step S1, a first run-up test is initially carried out, during which the injection is active for all NZ cylinders of engine 9 to be tested.

In step S2, the absolute total injection quantity $M_{inj}$ is determined from the recorded measurement variables, namely first rate of change $a_1$, at which engine speed n increases in run-up phase "B," the second rate of change $a_2$, at which engine speed n drops in the free-fall phase "C," and the reached maximum engine speed $n_{max}$ at the end of run-up phase "B". Based thereupon, the average injection quantity may already be deduced per cylinder or for each of the injectors.

The run-up test is subsequently repeated according to the number NZ of cylinders of the engine; in each case the injection is inactive for one of the individual cylinders, i.e., no injection is carried out in one cylinder.

In step S3, a control variable n=1 is set.

in step S4 it is checked whether the control variable n is greater than the number NZ of the cylinders of the engine. If this is true then all additional necessary run-up tests have been carried out and the method continues to Step S8. Otherwise, the method branches to Step S5.

In step S5, the respective second run-up test n is repeated as in steps S1 and S2; however, in contrast thereto, no injection is carried out in the cylinder assigned to the control variable, i.e., nz=NZ−1.

In step S6, the absolute total injection quantity is ascertained from the ascertained measurement values of the presently carried out run-up test n.

This takes place in turn with the aid of the correlation (4), a second factor f(nz=NZ−1) being used instead of factor f(nz=NZ), since, for the output achieved by the engine at NZ−1 active cylinders, another correlation applies than with NZ active cylinders.

In step S7, the control variable is incremented, i.e., n:=n+1. Thereafter, the method branches to step S4.

In step S8, the individual injection quantity drift is determined for each individual injector, based on the ascertained first absolute total injection quantity and the NZ second absolute total injection quantities. For this purpose, in each case, the second absolute injection quantity for a certain injector, which was ascertained during the run-up test during which the cylinder associated with the injector was inactive, is subtracted from the first absolute total injection quantity, and the result is divided by the number N of injections per cylinder.

In step S8, the above correlation (4) may be used alternatively or additionally in order to ascertain the relative quantity differences from the tests with an inactive cylinder, while the absolute injection quantity arises from the test (steps S1 and S2) with all cylinders NZ active.

The method. subsequently ends; the ascertained results may be output on a display or a printer.

The part of the method identified with "I" in FIG. 3 is used for determining the first absolute total injection quantity with the aid of a test run in which the injection is active in all cylinders.

The part of the method identified with "II" in FIG. 3 is used for determining a second absolute total injection quantity in each case with the aid of a test run in which the injection is inactive in one of the cylinders.

What is claimed is:

1. A method for ascertaining an absolute fuel injection quantity of injectors of an internal combustion engine having NZ cylinders, the method comprising:

idling the engine at an idling speed $n_{idle}$, using an idling speed controller;

at a first point in time, performing a run-up test on the engine using an engine controller, the run-up test including linearly increasing a speed of the engine, during active injection, at a constant first slope $a_1$ until a second point in time from the idling speed $n_{idle}$ to a maximum engine speed $n_{max}$, wherein at the second point in time, injection is inactive so that the engine speed drops at a second slope $a_2$, wherein the run-up test is performed with all cylinders being active;

ascertaining a first absolute total injection quantity $M_{inj}$ (nz=NZ) of all the injectors based on the run-up test in which all cylinders of the engine are active and a predetermined engine-specific factor f (nz=NZ) of the engine which was determined for the case in which all cylinders are active; and using the first absolute total injection quantity $M_{inj}$(nz = NZ) to diagnose the engine;

wherein $M_{inj}$(nz) is ascertained based on the following correlation $$M_{inj}(nz) = f(nz) \cdot \left(n_{max}^2 + (n_{max}^2 - n_{idle}^2) \cdot \frac{a_2}{a_1} - n_{idle}^2\right)$$

where f(nz) is a constant, predetermined factor for the engine at nz active cylinders.

2. The method of claim 1, wherein at least one second absolute total injection quantity $M_{inj}$(nz=NZ−1) is ascertained, based on measurement data of an additional run-up test in which at least one of the cylinders is inactive and an engine-specific factor f(nz−1) which was determined for the case of one inactive cylinder.

3. The method as recited in claim 2, further comprising:

repeating the run-up test NZ times, in each case, a different one of the NZ cylinders being inactive;

ascertaining a respective absolute injection quantity for each of the cylinders based on the run-time test in which the respective cylinder is inactive, and using $M_{inj}$(nz):

$$M_{inj}(nz) = f(nz) \cdot \left(n_{max}^2 + (n_{max}^2 - n_{idle}^2) \cdot \frac{a_2}{a_1} - n_{idle}^2\right)$$

wherein f(nz=NZ−1) is a constant, predetermined factor for the engine at nz=NZ−1 active cylinders; and ascertaining a drift in each of the individual ones of the cylinders based on the ascertained first absolute total injection quantity and the ascertained respective absolute injection quality for the respective cylinder.

4. The method as recited in claim 1, wherein the first absolute total injection quantity $M_{inj}$(nz=NZ) is a total injection quantity of all injections during the run-up test.

5. A non-transitory computer readable medium on which is stored a computer program including program code for ascertaining an absolute fuel injection quantity of injectors of an internal combustion engine having NZ cylinders, the program code, when executed by a programmable device, causing the programmable device to perform:

idling the engine at an idling speed $n_{idle}$, using an idling speed controller;

at a first point in time, performing a run-up test on the engine using an engine controller, the run-up test including linearly increasing a speed of the engine, during active injection, at a constant first slope $a_1$ until a second point in time from the idling speed $n_{idle}$ to a maximum engine speed $n_{max}$, wherein at the second point in time, injection is inactive so that the engine speed drops at a second slope $a_2$, wherein the run-up test is performed with all cylinders being active;

ascertaining a first absolute total injection quantity $M_{inj}$(nz=NZ) of all the injectors based on the run-up test in which all cylinders of the engine are active and a predetermined engine-specific factor f(nz = NZ) of the engine which was determined for the case in which all cylinders are active;

using the first absolute total injection quantity $M_{inj}$(nz=NZ) to diagnose the engine;

wherein $M_{inj}$(nz) is ascertained based on the following correlation $$M_{inj}(nz) = f(nz) \cdot \left(n_{max}^2 + (n_{max}^2 - n_{idle}^2) \cdot \frac{a_2}{a_1} - n_{idle}^2\right)$$

where f(nz) is a constant, predetermined factor for the engine at nz active cylinders;

wherein the program code is configured so that the program code is executable on the programmable device, which includes a repair shop diagnostic device and/or an engine controller.

6. The non-transitory computer readable medium as recited in claim 5, wherein the first absolute total injection quantity $M_{inj}$(nz=NZ) is a total injection quantity of all injections during the run-up test.

7. A system, comprising:

a programmed repair shop diagnostic device connectable via an interface to a controller of an internal combustion engine having NZ cylinders, the diagnostic device configured to:

idle the engine at an idling speed $n_{idle}$, using an idling speed controller;

at a first point in time, perform a run-up test on the engine using the engine controller, the run-up test including linearly increasing a speed of the engine, during active injection, at a constant first slope $a_1$ until a second point in time from the idling speed $n_{idle}$ to a maximum engine speed $n_{max}$, wherein at the second point in time, injection is inactive so that the engine speed drops at a second slope $a_2$, wherein the run-up test is performed with all cylinders being active;

ascertain a first absolute total injection quantity $M_{inj}$(nz=NZ) of all the injectors based on the run-up test in which all cylinders of the engine are active and a predetermined engine-specific factor f(nz=NZ) of the engine which was determined for the case in which all cylinders are active; and use the first absolute total injection quantity $M_{inj}$(nz=NZ) to diagnose the engine;

wherein $M_{inj}$(nz) is ascertained based on the following correlation $$M_{inj}(nz) = f(nz) \cdot \left(n_{max}^2 + (n_{max}^2 - n_{idle}^2) \cdot \frac{a_2}{a_1} - n_{idle}^2\right)$$

where f(nz) is a constant, predetermined factor for the engine at nz active cylinders.

8. The system as recited in claim 7, wherein the first absolute total injection quantity $M_{inj}$(nz=NZ) is a total injection quantity of all injections during the run-up test.

* * * * *